US007464812B2

(12) United States Patent
Wright et al.

(10) Patent No.: US 7,464,812 B2
(45) Date of Patent: Dec. 16, 2008

(54) COVER FOR THE HEAD OF A GOLF CLUB

(76) Inventors: Carson Wright, 2 Portview, Bangor, County Down (GB) BT20 5QB; Jack Kyle, deceased, late of Bangor (GB); by Gail Kyle, legal representative, 4 Elsinore Avenue, Bangor, County Down (GB) BT19 1EN ( * ) Notice: Subject to any disclaimer, the term of this patent is extended or adjusted under 35 U.S.C. 154(b) by 56 days.

(21) Appl. No.: 10/493,136

(22) PCT Filed: Oct. 23, 2003

(86) PCT No.: PCT/EP02/10651

§ 371 (c)(1),
(2), (4) Date: Nov. 28, 2006

(87) PCT Pub. No.: WO03/035188

PCT Pub. Date: May 1, 2003

(65) Prior Publication Data

US 2007/0178989 A1 Aug. 2, 2007

(51) Int. Cl.
*A63B 57/00* (2006.01)

(52) U.S. Cl. ..... 206/315.2; 150/159; 150/160; 206/315.4

(58) Field of Classification Search ..... 205/315.2, 205/315.4; 150/159, 160; 473/256, 342
See application file for complete search history.

(56) References Cited

U.S. PATENT DOCUMENTS 3,058,767 A 10/1962 Baker
3,680,870 A * 8/1972 Burnett et al. ..... 473/256
3,967,667 A * 7/1976 Robinson ..... 206/315.6
4,119,129 A 10/1978 Freiberg
4,898,222 A 2/1990 Gaffney
5,294,127 A 3/1994 Keelan
5,615,720 A 4/1997 O'Sullivan
5,944,081 A 8/1999 Aldcroft et al.
6,065,516 A 5/2000 Chang
6,116,307 A * 9/2000 Mangigian et al. ..... 150/160
2002/0124920 A1 * 9/2002 Noyes ..... 150/160

FOREIGN PATENT DOCUMENTS

JP 2001 137406 A 3/2001
JP 2002 353245 A 12/2001
JP 2001353245 A * 12/2001

* cited by examiner

*Primary Examiner*—Sue A Weaver
(74) *Attorney, Agent, or Firm*—Van Dyke, Gardner, Linn & Burkhart, LLP

(57) ABSTRACT

The present invention provides a cover for the head of a golf club, especially a putter. The cover comprises a hollow body having an open end, the body being arranged to define a slot which opens onto the open end of the body. The slot is shaped and arranged to receive a portion of the club when the club head is located in the body and to prevent withdrawal of the club head from the body in an axial direction. In the preferred embodiment, the slot is substantially L-shaped so that the cover must first be rotated before it can be removed. The cover offers good protection to a club head while being simple to fit and remove.

18 Claims, 4 Drawing Sheets

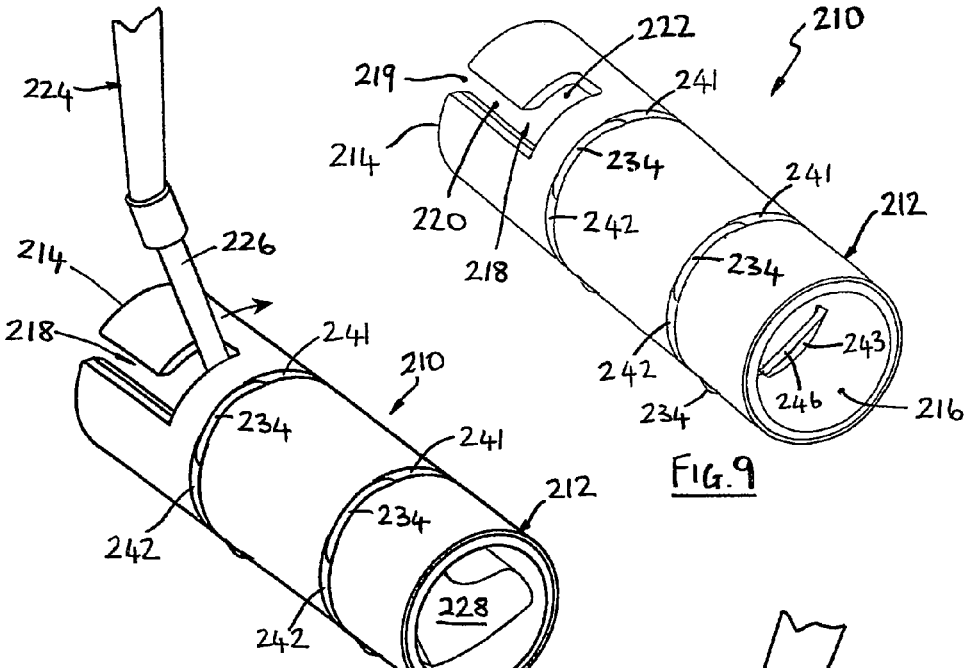
FIG. 9
FIG. 10
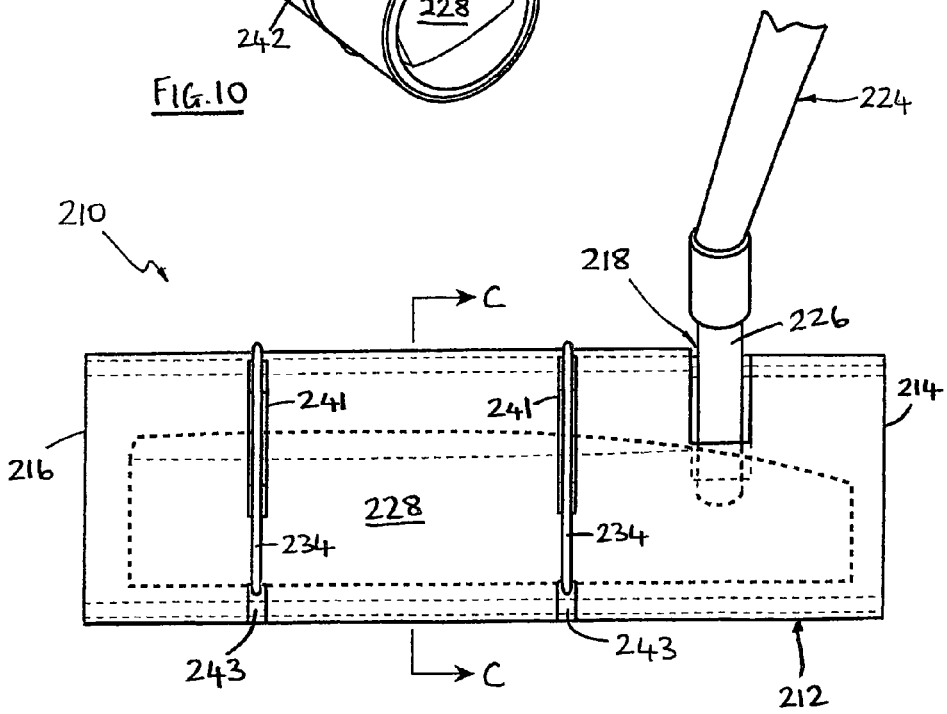
FIG. 11

COVER FOR THE HEAD OF A GOLF CLUB

FIELD OF THE INVENTION

The present invention concerns a cover for the head of a golf club, particularly a putter.

BACKGROUND TO THE INVENTION

Much research and development has been carried out by golf club manufacturers to improve the performance of golf clubs. This is particularly true for putters, in respect of which many technical improvements relate to the use of exotic materials in the construction of the putter head. In place of the traditional steel head putters, a variety of soft alloys are now employed, and the heads will often include a plastic or carbon fibre insert in the face to provide extra feel when putting. Such putters have proved successful and are popular amongst today's golfers. However, the use of such exotic materials and composite configurations has led to an increase in the manufacturing and retail costs of such putters. Moreover, these putters are particularly susceptible to damage if the club head contacts, for example, the head of another club in a golfer's bag. It is therefore more important than ever to protect the head of the putter from damage while not in use.

Known covers for putters, or other golf clubs, are generally manufactured from soft, pliable material such as leather or fabric. Many are loosely fitting and require hook type fasteners, which tend to wear out, in addition to being tiresome to fit and remove. The cushioning affect of soft material usually deteriorates with use and the cover tends to become cut, torn or split.

It would be desirable, therefore, to provide a cover for the head of a golf club, particularly a putter, which may be fitted and removed with relative ease. It would also be desirable for the cover to be sufficiently robust to protect the club head from impact damage and to withstand prolonged use.

SUMMARY OF THE INVENTION

Accordingly, the present invention provides a cover for the head of a golf club, the cover comprising a hollow body having an open end, the body being arranged to define a slot, which slot opens onto the open end of the body, the slot being shaped and arranged to receive a portion of the club when the club head is located in the body and to prevent withdrawal of the club head from the body in an axial direction.

Preferably, the slot is shaped to provide at least one substantially transverse slot edge against which said portion of the club may engage to prevent withdrawal of the club head from the body in an axial direction.

Preferably, the slot comprises an axial portion and a transverse portion, the axial portion extending substantially parallely with the longitudinal axis of the body and opening onto the open end of the body, the transverse portion extending substantially perpendicularly from said longitudinal portion. More preferably, the slot is substantially L-shaped.

Preferably, the body is substantially cylindrical in shape. Advantageously, the body is formed from a substantially rigid material.

Preferably, the cover further includes means for gripping a club head located within the body when the cover adopts a locked state, said locked state corresponding to the state wherein said portion of the club is positioned in the slot such that withdrawal of the club head in longitudinal direction is prevented.

Preferably, the body is shaped to define one or more sets of one or more apertures, the gripping means comprising one or more resilient bands located, in use, around the exterior of the body and in register with a respective set of one or more apertures such that one or more respective portions of a respective resilient band protrude through a respective aperture into the body. More preferably, the or each set of apertures comprises two or more apertures radially spaced-apart with respect to the longitudinal axis of the body.

Preferably, the or each aperture is arranged so that the or each resilient band portion which protrudes into the body does not interfere with insertion or removal of the club head to or from the body in an axial direction but engages with the club head when the cover is in the locked state.

Other advantageous aspects of the invention will become apparent to those ordinarily skilled in the art upon review of the following technical description of specific embodiments of the invention and with reference to the accompanying drawings.

BRIEF DESCRIPTION OF THE DRAWINGS

Preferred embodiments of the present invention are now described by way of example and with reference to the accompanying drawings, in which:

FIG. 9 shows a perspective view of a preferred embodiment of a cover according to the invention;

FIG. 10 shows the cover of FIG. 9 in situ on a golf club head;

FIG. 11 shows a side elevation of the cover of FIG. 9, including the golf club head;

DETAILED DESCRIPTION OF THE DRAWINGS

Figure 1:
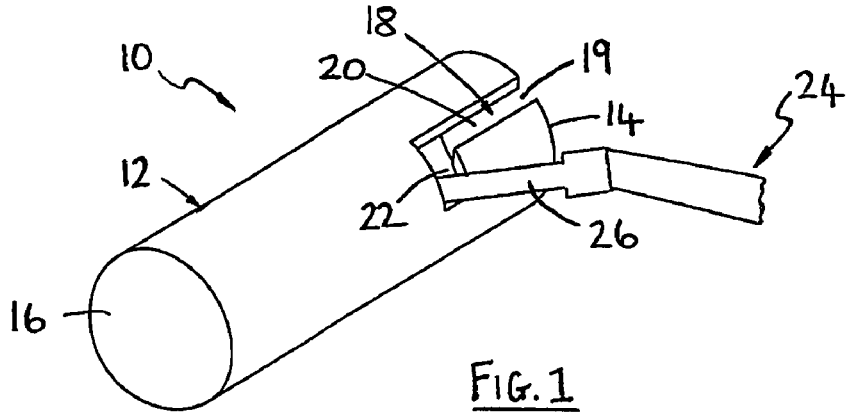
FIG. 1 shows a perspective view of a first embodiment of a cover for a head of a golf club according to the present invention, the cover being shown in situ on a golf club head.
Figure 2:
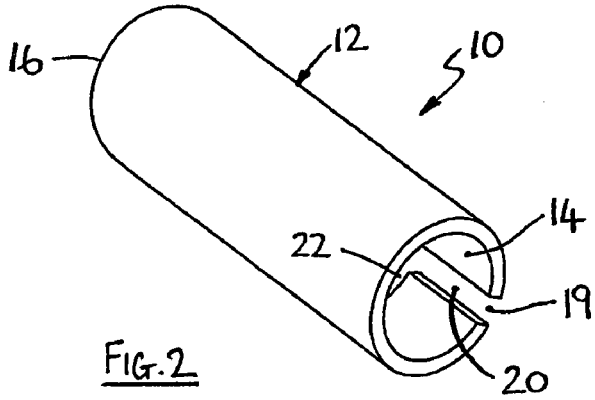
FIG. 2 shows an alternative perspective view of the cover of FIG. 1, in which the head of the golf club has been removed for clarity.
Figure 3:
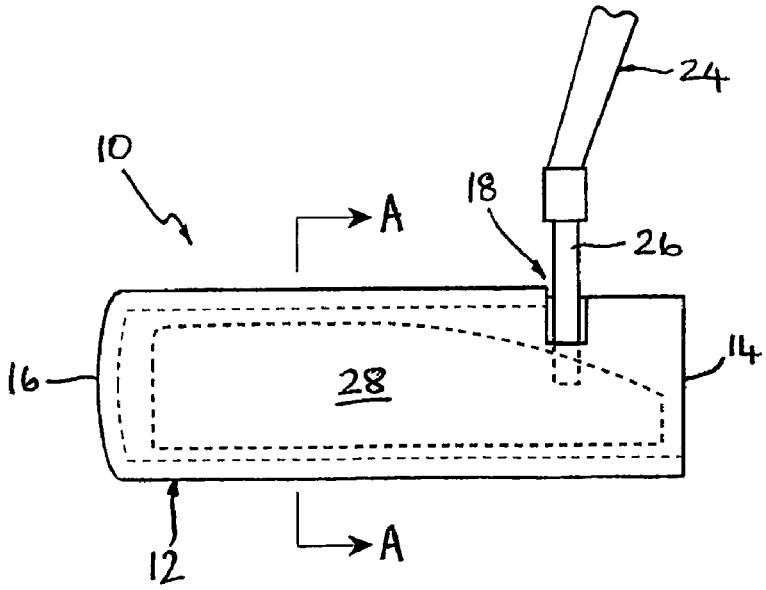
FIG. 3 shows a side elevation of the cover of FIG. 1, including the golf club head.
Figure 4:
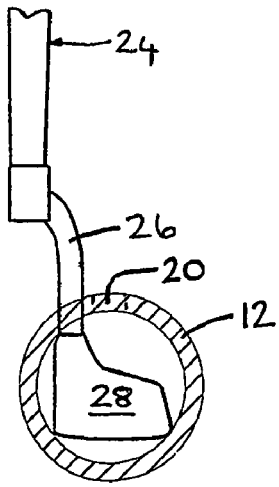
FIG. 4 shows a sectioned end elevation of the cover of FIG. 1, taken along the line AA of FIG. 3.
Figure 5:
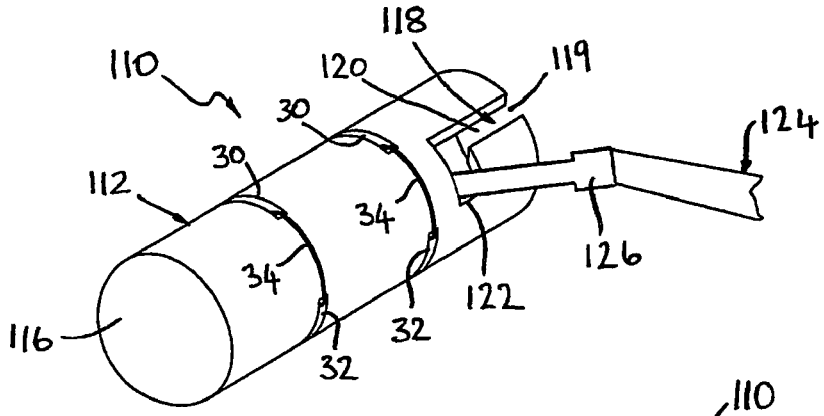
FIG. 5 shows a perspective view of a second embodiment of a cover for a head of a golf club according to the present invention, the cover being shown in situ on a golf club head.
Figure 6:
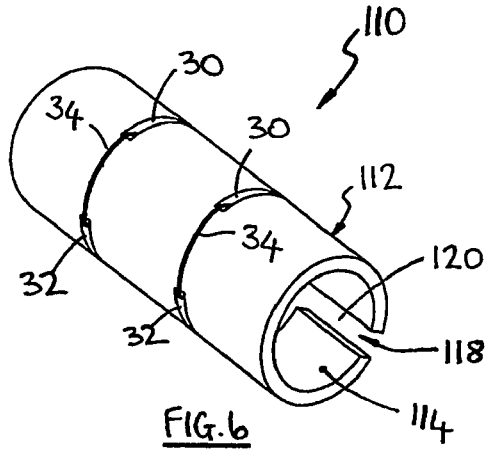
FIG. 6 shows an alternative perspective view of the cover of FIG. 5, in which the golf club has been removed for clarity.
Figure 7:
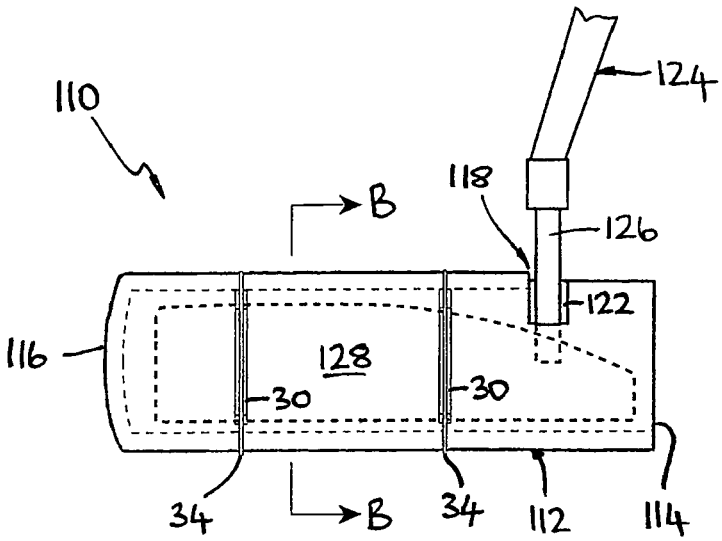
FIG. 7 shows a side elevation of the cover of FIG. 5, including the golf club head.

Referring now to FIGS. 1 to 4 of the drawings, there is illustrated a first embodiment of a cover, generally indicated as 10, for location about the head 28 of a golf club in order to protect the head 28 from damage. The cover 10 is particularly, but not exclusively, suitable for use with a putter. FIGS. 3 and 4 best illustrate an example putter 24 having a head 28 connected to a shaft 26. The shaft 26 is generally perpendicular to the longitudinal axis of the head 28 so that the putter 24 is substantially L-shaped, or in some cases substantially T-shaped. It is common however for the shaft, or at least part of the shaft, to be inclined from the perpendicular at an angle of, typically, up to about 30°.

In the present embodiment, the cover 10 comprises a substantially cylindrical body 12 which is preferably formed from a substantially rigid material. Preferably, the material chosen should be sufficiently rigid such as to withstand at least light to moderate impacts without undergoing any appreciable deformation. Such rigidity prevents damage to the head 28 upon contact of the cover 10 with an object such as another club (not shown) or the like. The body 12 should preferably also have sufficient resilience to prevent cracking or breakage upon any such contact or impacts. Plastics are particularly suitable materials for the cover 10, having the above desired qualities while being inexpensive to produce. However, there are a variety of other materials which would be suitable for forming the body 12, for example carbon fibre, steel or aluminium. It is preferable however that the material used to form the cover 10 be softer than the head 28, or at least any face insert (not shown) contained in the head 28, in order to ensure that the head 28 or the face insert (not shown) is not inadvertently scratched or damaged during application or removal of the cover 10.

In the embodiment of FIGS. 1 to 4, one end 14 of the body 12 is open and the opposite end 16 is closed. The open end 14 permits the head 28 of the putter 24 to be inserted into the cover 10, while the closed end 16 reduces the ingress of unwanted contaminants or the like which may damage or corrode the head 28 of the putter 24. It will be appreciated from the following description of the operation of the cover 10 that, although the closed end 16 is preferred, it is not essential and may be replaced by an open end.

The body 12 is shaped to define a locking slot 18. The locking slot 18 comprises an open-ended slot having a mouth 19 which opens onto the open end 14 of the body 12. Preferably, the locking slot 18 comprises an axial portion 20 disposed substantially parallel to the longitudinal axis of the body 12, and a transverse portion 22 disposed substantially perpendicular to the longitudinal axis of the body 12. In the illustrated embodiment, the transverse slot portion 22 extends substantially circumferentially about part of the body 12. It will be understood that variations in the relative angular disposition between the axial and transverse slot portions 20, 22 and between the slot portions 20, 22 and the body 12 are possible, provided that such variations do not materially affect the intended operation of the cover 10, as hereinafter described.

The term "axial direction" as used hereinafter refers to the direction of, or a direction parallel with, the longitudinal axis of the body 12, and also corresponds with the general direction of insertion or withdrawal of the club head into or from the cover. In the illustrated embodiments, the axial direction also corresponds with the longitudinal axis of the club head when located in the cover.

In use, a user (not shown) inserts the head 28 into the body 12 through the open end 14 in a generally axial direction. Prior to, or during insertion of the head 28, the body 12 is positioned such that the mouth 19 of the locking slot 18 is aligned with the shaft 26 of the putter 24. The head 28 is then pushed further into the body 12 such that the shaft 26 passes through the mouth 19 and along the axial slot portion 20. Once the shaft 26 reaches the junction between the axial portion 20 and the transverse portion 22, the user effects relative movement between the head 28 and the cover 10 such that the shaft 26 enters the transverse portion 22. Conveniently, this is achieved by twisting, or rotating, the cover 10 about its longitudinal axis. The cover 10 is fully fitted on the head 28 once the shaft 26 reaches the end of the transverse slot portion 22. When the shaft 26 is located in the transverse slot 22, the cover 10 cannot be drawn off the head 28 just by a simple pulling or tugging action in the axial direction because the shaft 26 will engage against the edge of the transverse slot 22. Rather, the user must first effect relative rotation, or twisting, between the cover 10 and the head 28 so that the shaft 26 is again located in the axial slot portion 20—the cover 10 can then be removed from the head 28 by pulling in the axial direction. Thus, with the shaft 26 located in the transverse slot portion 22 the cover 10 may be said to occupy a locked state from which the cover 10 is not easily dislodged accidentally. Preferably, the width (in an axial direction) of the transverse slot 22 is similar in width to the shaft 26. This is particularly advantageous in cases where the cover 10 is formed from plastics, or other resilient material, which can then serve to grip the shaft 26 when in the locked state.

It will be appreciated from the foregoing that the cover 10 offers good protection to the head 28 while being simple to fit and remove.

It will be understood that the actual dimensions of the cover 10 may be arranged to suit a particular club head, or range of club heads. In particular, the length, cross-sectional area and cross-sectional shape of the body 12 may be varied, as can the dimensions of the locking slot 18.

Referring now to FIGS. 5 to 8 of the drawings, there is illustrated an alternative embodiment of a cover, generally indicated as 110, for a head 128 of a putter 124. In this alternative embodiment, like components or features have been accorded like reference numerals, and unless otherwise stated, perform or have like functions. The cover 110, therefore includes a body 112 having an open end 114 and a closed end 116, and a locking slot 118 extending inwardly of the body 112 from the open end 114. The locking slot 118 comprises an axial portion 120 and a transverse portion 122 extending from the axial portion 120.

The cover 110 includes gripping means, or a stabiliser, to help retain the cover 110 on the head 128 and to reduce relative movement between the head 128 and the cover 110, when fitted. Preferably, the gripping means takes the form of one or more resilient bands 34—made, for example, from rubber or the like—which are each partially disposed internally of the body 112 and partially disposed externally of the body 112. To this end, the body 12 is shaped to define a set of one or more apertures in respect of the or each band 34, through which aperture(s) a respective portion of a respective band 34 may protrude inside the body 112. Within each set, where there is more than one aperture in each set, the apertures are spaced-apart transversely around the body 112. In the embodiment of FIGS. 5 to 8, the cover 110 is adapted for use with two bands 34 and therefore includes two sets of apertures for receiving the respective bands 34. In this example, each set of apertures comprises two apertures, namely a respective first aperture 30 and a respective second aperture 32. The respective first and second apertures 30, 32 are circumferentially spaced-apart around the body 112 and are, preferably, oppositely disposed on the body 112. Each aperture 30, 32 is dimensioned to allow a portion of a resilient band 34 to pass through into the body 112, as illustrated in FIGS. 5 to 8.

Figure 8:
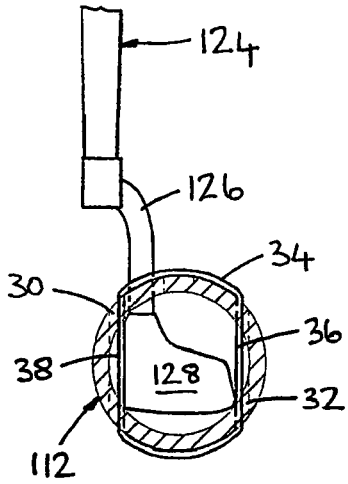
FIG. 8 shows a sectioned end view of the cover of FIG. 5, taken along the line BB of FIG. 7.
Figure 12:
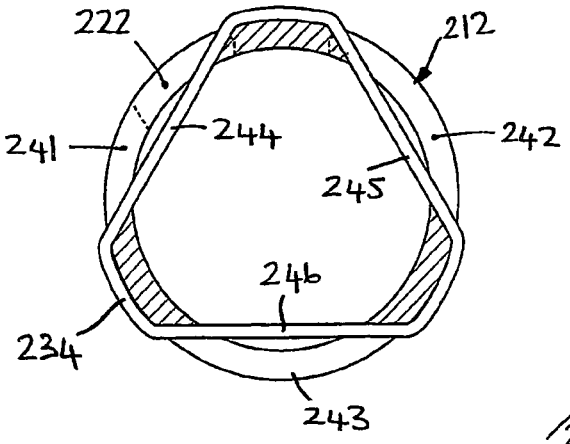
FIG. 12 shows a sectioned end view of the cover of FIG. 9 taken along the line CC.

In use, a respective resilient band 34 is located transversely, or circumferentially, around the body 112 in register with a respective first and second aperture 30 and 32. Hence, respective portions of respective bands 34 protrude through respective apertures 30, 32 into the body 112. This is best illustrated by FIG. 8, which shows two portions 36, 38 of a band 34 located inside the body 112 while the remainder of the band 34 is supported by the exterior surface of the body 112. The dimensions and resilience of the bands 34 is such that the bands 34, including portions 36, 38, are held taut.

The cover 110 is fitted to the head 128 as described above for FIGS. 1 to 4. Preferably, the apertures 30, 32 are arranged so that the respective portions 36, 38 of the bands 34 that are inside the body 112 do not interfere with the head 128 as it is inserted into the body 112. However, upon relative rotation of the cover 112 and the head 128, the head 128 engages with the respective portions 36, 38 of each resilient band 134, which portions 36, 38 then deform under tension to accommodate the head 128. Hence, the portions 36, 38 of the bands 34 exert a gripping action on the head 128, thereby effecting a secure fit between the cover 110 and the head 28 regardless of whether the head 128 is a precise fit within the body 112. The resilient bands 34 reduce any vibratory movement between the cover 110 and the head, which may otherwise result in the body 112 inadvertently rotating about the head 128, resulting in the accidental displacement of the cover 110 from the putter 124.

FIGS. 9 to 14 illustrate a preferred embodiment of the invention in the form of a cover 210. The cover 210 is generally similar to covers 10, 110 (although it will be noted that cover 210 is open at both ends 214, 216) and similar numerals are used in the drawings to indicate like parts. However, for cover 210 each set of band-receiving apertures comprises a respective three apertures 241, 242, 243. Within each set, the apertures 241, 242, 243 are transversely, or circumferentially, spaced-apart around the body 212 and are preferably evenly spaced, i.e. corresponding points in adjacent apertures being approximately 60° apart.

Hence, when a resilient band 234 is located around a set of three apertures 241, 242, 243, three portions 244, 245, 246 of the band 234 protrude into the body 212 (as can best be seen in FIGS. 12 to 14), the remainder of the band 234 being located against the exterior surface of the body 212. In the embodiment shown in FIGS. 9 to 14, the cover 212 has two sets of apertures although it will be understood that, in alternative embodiments (not shown), there may be one or more sets of apertures.

Figure 13:
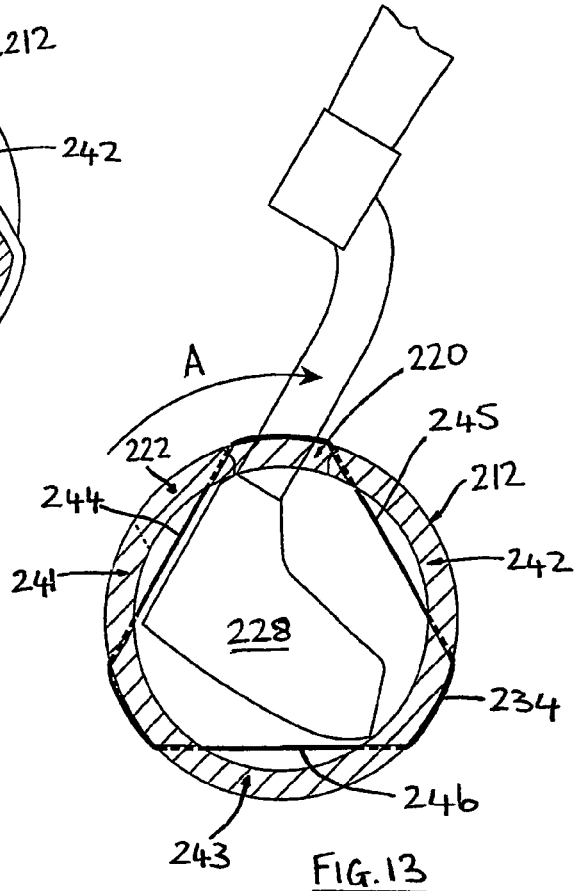
FIG. 13 shows a first end view of the cover of FIG. 9 in situ on a golf club head.
Figure 14:
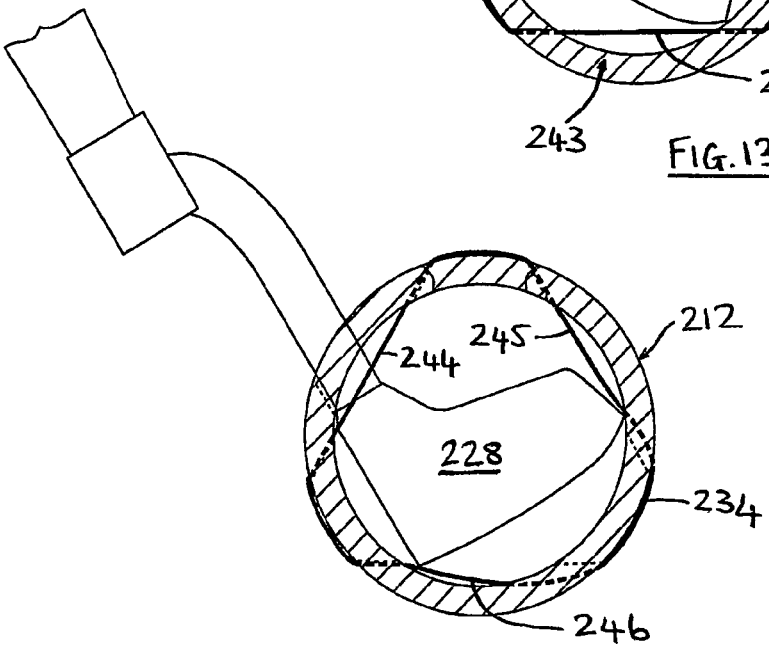
FIG. 14 shows a second end view of the cover of FIG. 9 in situ on a golf club head.

The apertures 241, 242, 243 are preferably arranged so the respective portions 244, 245, 246 of the bands 234 do not interfere with the ingress of the head 228. This is best illustrated in FIG. 13 which shows the cover 210 in the process of being fitted to a putter 224, the shaft 226 of the putter 224 being located in the axial slot 220 as the head 228 is being inserted into the body 212. During this process, it will be seen that the head 228 does not engage with the portions 244, 245, 246 of the band 234 and so the ingress of the head 228 is not impeded by the resilient bands 234. Once the head 228 is fully inserted into the body 212, the cover 210 is rotated in the direction indicated by arrow A in FIG. 13 to move the shaft 226 into the transverse slot portion 222, i.e. to lock the cover 210 in place. Relative rotation between the head 228 and the cover 210 causes the head 228 to engage with the respective portions 244, 245, 246 of the resilient bands 234 as shown in FIG. 14. Thus, the head 228 causes the resilient bands 234 to deform which in turn causes the resilient bands to exert a gripping action on the head 234. The gripping action exerted by the resilient bands 234 on the head 228 serves to secure the cover 210 in the locked state. In FIG. 14, the head 228 is shown as causing only slight deformation of the resilient bands 234 although it will be understood that in alternative embodiments (not shown) the amount of deformation caused by the head will depend on the relative positions of the locking slot and the resilient bands.

In a particularly preferred embodiment (not shown) one or more padding strips made from, for example, plastics may be inserted between one or more portions 244, 245, 246 of the bands 234 and the respective aperture 30, 32 through which they protrude. The padding strips serve to push the band portions 244, 245, 246 further into the body 212 and this allows the band portions 244, 245, 246 to engage with smaller club heads which may not otherwise allow the band portions 244, 245, 246 to exert a gripping action thereon.

It will be understood that other suitable gripping means, stabiliser or padding (not shown) may be used in place of the resilient bands 34, 234. For example, a layer of resiliently deformable sponge, foam rubber, or similar material may be provided on the internal wall, or a portion thereof, of the body 12, 112, 212, for gripping the head 28, 128, 228, particularly in the locked state. This helps to allow the cover to accommodate club heads of differing sizes.

When not in use, the cover 10, 110, 210 fitted onto a handle of an umbrella or golf cart (not shown), in order to prevent loss of the cover 10, 110. In addition, the external surface of the body 12, 112 may be moulded or produced in any desired shape, whether for the purposes of novelty, to incorporate a given Trade Mark, or for any other reason.

In the illustrated embodiments, the slot 18, 118, 218 receives and engages with the shaft 26, 126, 226 of the club 24, 124, 224. However, depending on the configuration of the club, the slot 18, 118, 218 may alternatively receive and engage with any other portion of the club which is adjacent the head. For example, in some cases, a putter head (not shown) is shaped to define a neck portion to which the shaft is connected. In such cases, the arrangement may be such that the slot 18, 118, 218 receives and engages with the neck portion rather than the shaft itself.

The locking slot 18, 118, 218 need not necessarily be substantially L-shaped as shown in the accompanying drawings, but may take any alternative shape which provides one or more slot edges, especially substantially transverse slot edges, against which the club shaft, or neck, may engage to prevent withdrawal of the club head from the body in an axial direction. For example, the locking slot may alternatively be substantially U-shaped, J-shaped or T-shaped.

In alternative embodiments (not shown), the cover need not necessarily comprise a body of substantially circular transverse cross-section. Any other suitable transverse cross-sectional shape may be used. For example, the transverse cross-section may be hexagonal, octagonal or other regular or non-regular polygonal shape or curved shape. A substantially circular cross-section is preferred because it facilitates relative rotation of the club head and the cover, particularly in cases where the cross-sectional area of the club head is similar to that of the body.

In the preferred embodiments, the cover is formed from a substantially rigid, or semi-rigid material. It will be understood that materials of varying degrees of rigidity would be suitable for forming the body ranging from, for example, materials that are sufficiently rigid so as not to undergo any appreciable deformation under the normal pressures and impacts that may occur during normal use, to materials of sufficient rigidity to be self-supporting but which are readily deformed under normal pressures and impacts. In a further alternative embodiment (not shown), only the portion of the body (e.g. a collar portion) which defines the locking slot is substantially rigid, or semi-rigid, the remainder of the body comprising a flexible, or non-rigid, pouch. In such an embodiment, it is preferred that the pouch is padded, or is formed from material that is sufficiently thick to protect a club head located therein.

The present invention is not limited to the embodiments described herein, which may be amended or modified without departing from the scope of the present invention.

The invention claimed is:

1. A cover for the head of a golf club, said cover comprising a hollow body having an open end through which the club head may be inserted, during use, into said body in a generally axial direction, said body being arranged to define a slot comprising an axial portion extending substantially in said axial direction and opening onto said open end of said body, and a transverse portion extending substantially perpendicularly from said axial portion, the arrangement being such that, upon insertion of the club head into said body through said open end, a portion of the club is received by said axial portion and that, upon relative rotation of said body and the club head about said axial direction, the portion of the club is received by said transverse slot portion thereby preventing withdrawal of the club head from said body in said axial direction, wherein said slot is substantially L-shaped.

2. A cover as claimed in claim 1, wherein said transverse slot portion includes a substantially transverse edge against which the portion of the club may engage to prevent withdrawal of the club head from the body in an axial direction.

3. A cover as claimed in claim 1, wherein said body is substantially cylindrical in shape.

4. A cover as claimed in claim 1, wherein said cover further includes at least one resilient band, said band gripping the golf club head at least when the portion of the golf club head is received in said transverse portion of said slot.

5. A cover as claimed in claim 4, wherein said body includes at least one aperture, said resilient band being located in said aperture and protruding through said aperture into said body.

6. A cover as claimed in claim 4, wherein said cover includes a plurality of resilient bands, said bands gripping the golf club head at least when the portion of the golf club head is received in said transverse portion of said slot.

7. A cover as claimed in claim 6, wherein said body includes a plurality of said apertures and said resilient bands.

8. A cover as claimed in claim 7, wherein said apertures are radially spaced-apart with respect to said longitudinal axis of said body.

9. A cover for the head of a golf club, said cover comprising a hollow body having an open end through which the club head may be inserted, during use, into said body in a generally axial direction, said body being arranged to define a slot comprising an axial portion extending substantially in said axial direction and opening onto said open end of said body, and a transverse portion extending substantially perpendicularly from said axial portion, the arrangement being such that, upon insertion of the club head into said body through said open end, a portion of the club is received by said axial portion and that, upon relative rotation of said body and the club head about said axial direction, the portion of the club is received by said transverse slot portion thereby preventing withdrawal of the club head from said body in said axial direction, wherein said body is formed from a substantially rigid material.

10. A cover as claimed in claim 9, wherein said cover further includes means for gripping the club head located within said body when said cover adopts a locked state, said locked state corresponding to the state wherein the portion of the club is positioned in said slot such that withdrawal of the club head in longitudinal direction is prevented.

11. A cover as claimed in claim 9, wherein said transverse portion has at least one substantially transverse edge against which the portion of the golf club head may engage to prevent withdrawal of the club head from the body in an axial direction.

12. A cover as claimed in claim 9, wherein said slot is substantially L-shaped.

13. A cover as claimed in claim 9, wherein said body is substantially cylindrical in shape.

14. A cover for the head of a golf club, said cover comprising a hollow body having an open end through which the club head may be inserted, during use, into said body in a generally axial direction, said body being arranged to define a slot comprising an axial portion extending substantially in said axial direction and opening onto said open end of said body, and a transverse portion extending substantially perpendicularly from said axial portion, the arrangement being such that, upon insertion of the club head into said body through said open end, a portion of the club is received by said axial portion and that, upon relative rotation of said body and the club head about said axial direction, the portion of the club is received by said transverse slot portion thereby preventing withdrawal of the club head from said body in said axial direction, said cover further including means for gripping the club head located within said body when said cover adopts a locked state, said locked state corresponding to the state wherein the portion of the club is positioned in said slot so that withdrawal of the club head in longitudinal direction is prevented, wherein said body is shaped to define one or more sets of one or more apertures, said gripping means comprising one or more resilient bands located, in use, around said exterior of said body and in register with a respective set of one or more apertures such that one or more respective portions of a respective resilient band protrude through a respective aperture into said body.

15. A cover as claimed in claim 14, wherein the or each set of apertures comprises two or more apertures radially spaced-apart with respect to said longitudinal axis of said body.

16. A cover as claimed in claim 15, wherein the or each set of apertures comprises three apertures substantially evenly spaced-apart around said body.

17. A cover as claimed in claim 14, wherein the or each aperture is arranged so that the or each resilient band portion which protrudes into said body does not interfere with insertion or removal of the club head to or from said body in an axial direction but engages with the club head when said cover is in said locked state.

18. A cover as claimed in claim 14, wherein said body is formed from a substantially rigid material.

* * * * *